US007363735B2

(12) United States Patent
Riddle et al.

(10) Patent No.: US 7,363,735 B2
(45) Date of Patent: Apr. 29, 2008

(54) CALENDER

(75) Inventors: Stephen Anthony Riddle, Surrey (GB); Hugh Webb, London (GB)

(73) Assignee: Folders Galore Limited, London (GB)

( * ) Notice: Subject to any disclaimer, the term of this patent is extended or adjusted under 35 U.S.C. 154(b) by 303 days.

(21) Appl. No.: 11/302,196

(22) Filed: Dec. 14, 2005

(65) Prior Publication Data

US 2006/0207128 A1 Sep. 21, 2006

(30) Foreign Application Priority Data

Dec. 14, 2004 (GB) ..... 0427435.3

(51) Int. Cl.
*G09D 3/08* (2006.01)

(52) U.S. Cl. ..... 40/113; 40/114; 283/2; D19/25

(58) Field of Classification Search ..... 40/113, 40/114, 495; 283/2; D19/25
See application file for complete search history.

(56) References Cited

U.S. PATENT DOCUMENTS 900,310 A * 10/1908 Proctor ..... 40/115
1,280,837 A * 10/1918 Randall ..... 40/113
2,006,485 A * 7/1935 Segal ..... 40/115
2,952,932 A * 9/1960 Beer ..... 40/113
6,637,137 B2 * 10/2003 Coster et al. ..... 40/113

* cited by examiner

*Primary Examiner*—Cassandra Davis
(74) *Attorney, Agent, or Firm*—Clark & Brody

(57) ABSTRACT

A calendar comprising two sheets with one laid flat against the other and the sheets being moveable one over the other. One sheet bears the numbers "1" to "31" marked on it and the other sheet bears markings such that the numbers can be brought into registration with respective ones of the markings, successive markings being indicative of successive days of the week. Each month is represented by an indication on the sheet bearing the said markings adjacent to a marking indicative of that day of the week on which the first day of that month falls. Apertures are formed in the intended upper one of the sheets and further marks are provided on the intended underneath sheet such that when the indication of a given month on one of the sheets is brought adjacent to the number one on the other sheet, a mark appears through one of the apertures which is in registration with that number on the said one of the sheets which corresponds with the last day of the given month.

14 Claims, 4 Drawing Sheets

CALENDER

The present invention relates to a calendar.

Hitherto a calendar has comprised a series of sheets one for each month with the numbers of each day of the month arranged in a matrix of seven columns and four or five rows, the seven columns corresponding respectively to the seven days of the week in order, the numbers being written out sequentially from left to right and from top to bottom such that each number appears in the column which corresponds to the day of the week on which it falls.

A disadvantage of such a calendar is that it is relatively cumbersome, and whilst it may be hung on a wall it is often too cumbersome to rest on a desk, for example.

The present invention seeks to obviate this problem.

Accordingly the present invention is directed to a calendar comprising two sheets with one laid flat against the other and the sheets being moveable one over the other, one of the sheets being an intended lower sheet and the other sheet being an intended upper sheet, one sheet bearing the numbers "1" to "31" marked on it in order with uniform spacing between successive numbers and the other sheet bearing markings with uniform spacing between them such that the numbers can be brought into registration with respective ones of the markings, successive markings being indicative of successive days of the week in cyclical fashion for at least a full five weeks, so that the number 1 on the sheet bearing the numbers can be brought into registration with any selected one of the markings representing any day of the week, each month being represented by an indication on the sheet bearing the said markings adjacent to a marking indicative of that day of the week on which the first day of that month falls, there being apertures formed in the intended upper one of the sheets and further marks on the intended underneath sheet such that when the indication of a given month on one of the sheets is brought adjacent to the number one on the other sheet, a mark appears through one of the apertures which is in registration with that number on the said one of the sheets which corresponds with the last day of the given month.

It is desirable to have the intended lower sheet larger than the intended upper sheet so that there is useful exposed upper surface of the lower sheet which is not covered by the upper sheet.

Preferably, at least one of the sheets is in the form of a disc so that the calendar can be made in an especially compact form. Preferably, it is the intended upper one of the sheets which is circular. The intended lower sheet may also be in the form of a concentric disc, or alternatively it may be in the form of a rectangle to provide ends which can be grasped more easily, and so that it will fit more securely in an envelope.

Preferably, the discs are held together at their respective centres so that the discs are concentric and can be rotated relative to one another. This facilitates easy registration of the numbers with the markings.

The sheets may comprise card or a synthetic plastic material since these are relatively inexpensive, readily available materials. Card is more easily printed on, whereas synthetic plastics material is less susceptible to wear.

The apertures in the intended upper one of the discs may be circular holes, these being especially easy to punch, for example.

Alternatively, the apertures may be notches, for example V-shaped notches, cut into the periphery of the intended upper sheet.

The intended upper sheet may be translucent so that markings in the intended lower sheet can be seen through the intended upper sheet.

A relatively simple construction is facilitated if the intended lower sheet is the one that bears markings corresponding to the days of the week.

Successive month markers may be spaced apart around the sheet which bears the markings indicative of the days of the week, in the same order as that in which they occur during the year.

One readily available and simple device which can be used to hold two sheets together, in which one of the sheets is circular, is a plastics or metal rivet.

Examples of a calendar made in accordance with the present invention will now be described with reference to the accompanying drawings in which:

FIG. 1 shows a view of a first example of a calendar embodying the present invention from above, with an upper sheet thereof made to appear transparent to enable the markings on both the upper and lower sheets to the readily seen, with additional circles being drawn thereon for explanatory purposes, and with the months of the year also being represented outside the calendar for explanatory purposes which will come apparent;

Figure 1:
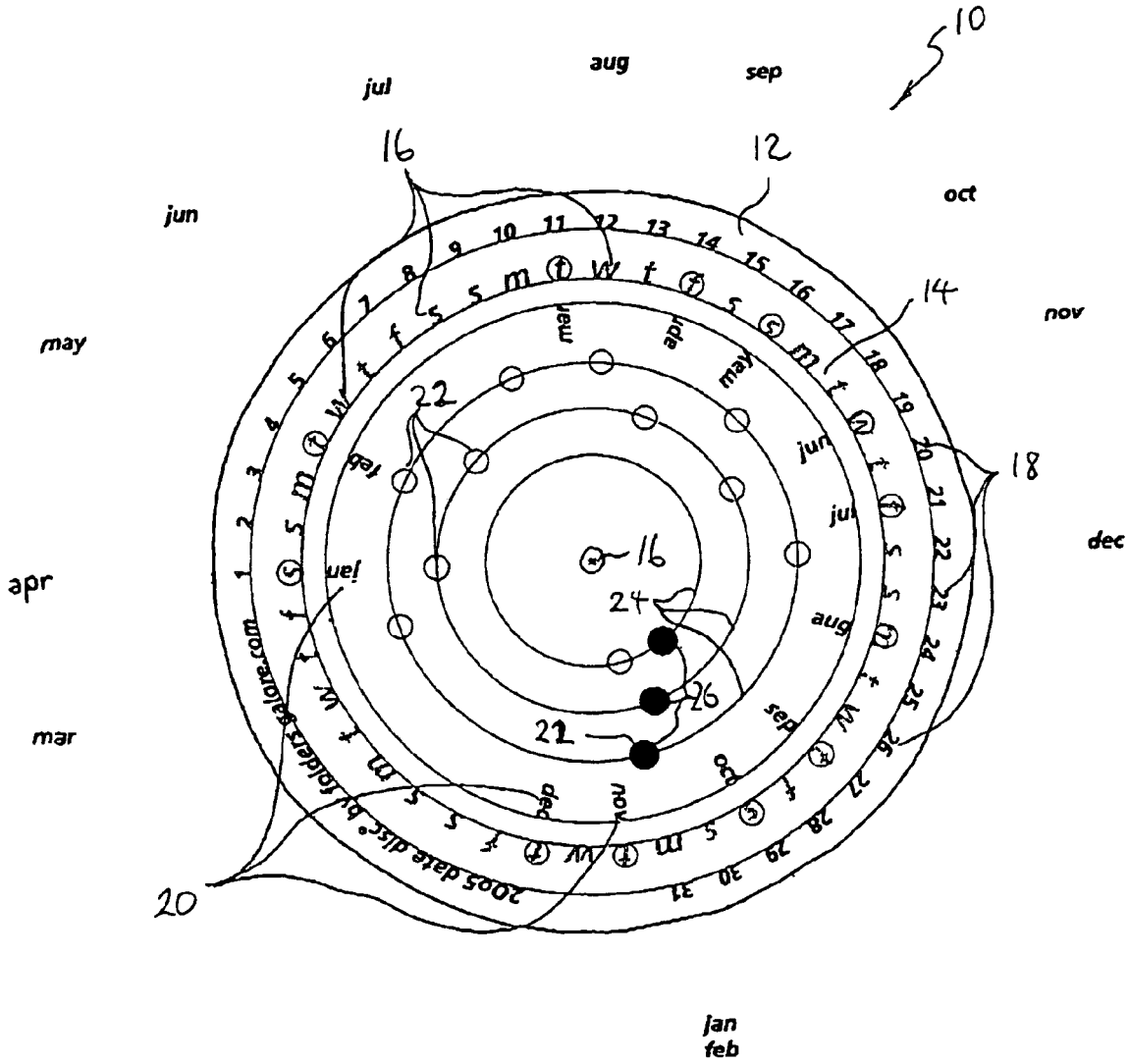
Figure 2:
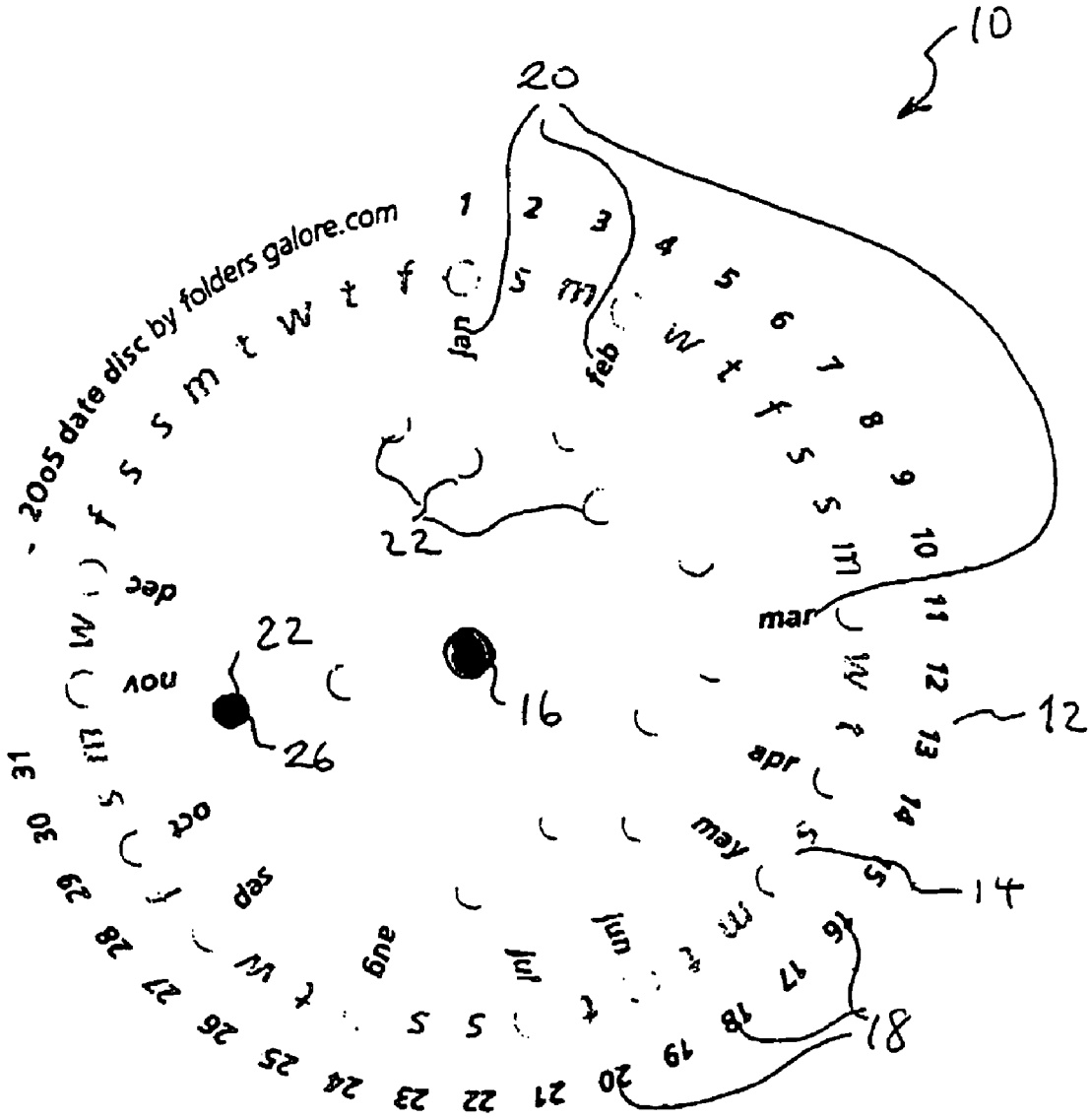
FIG. 2 shows a view of the calendar from above as it would appear when set appropriately for the month of January.
Figure 3:
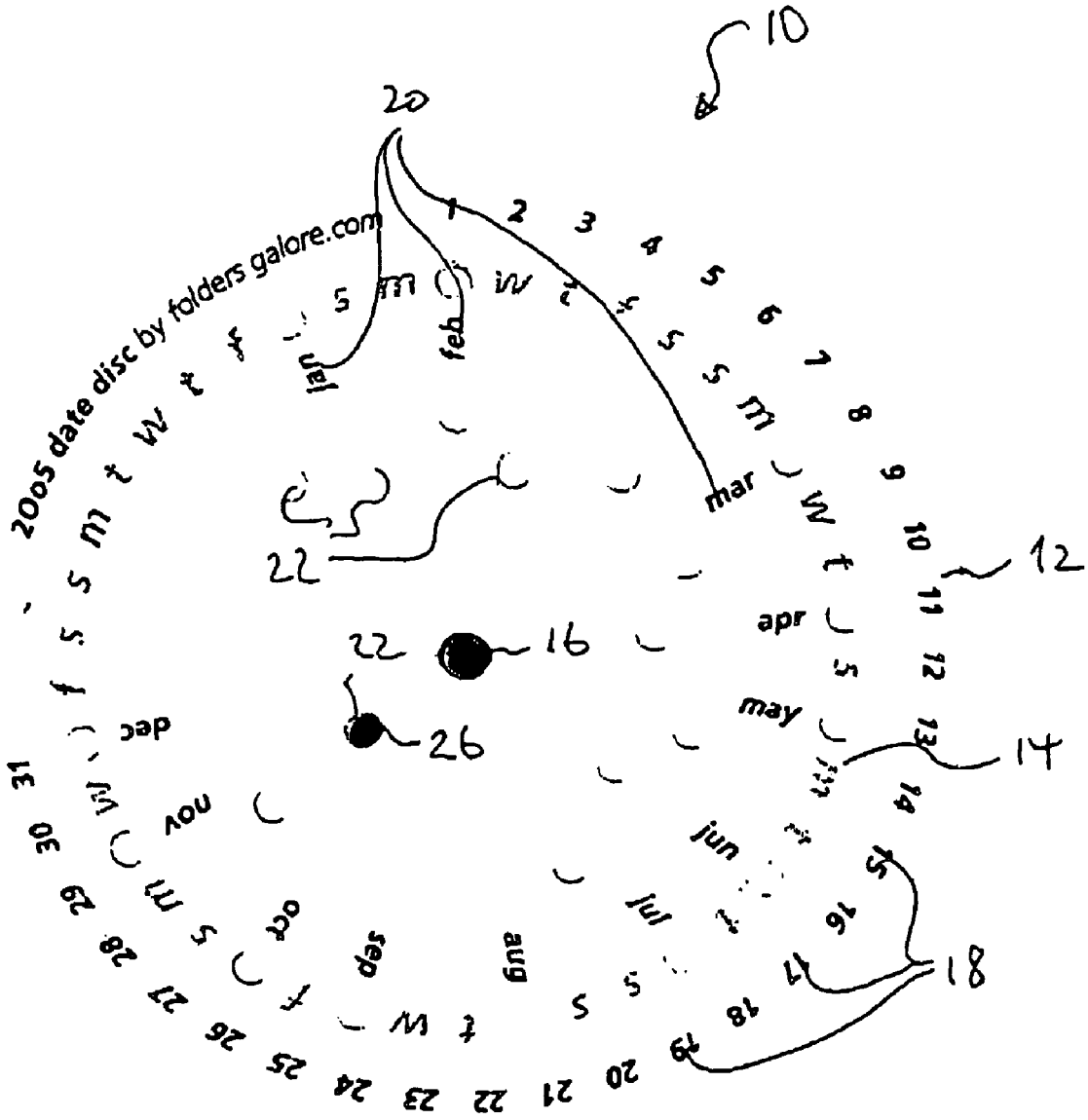
FIG. 3 shows a view of the calendar from above as it would appear when set appropriately for the month of February.

The calendar 10 shown in FIGS. 1 to 3 comprises a lower circular sheet 12 of card, and an upper circular sheet 14 of card held flat against the lower sheet 12 and secured thereto by way of a brass fastener 16 which extends through the centres of both sheets 12 and 14 so that they are concentric and may be rotated relative to one another. The lower sheet 12 has a larger diameter than the upper sheet 14, in this case the diameter of the lower sheet being substantially 12 cm and the diameter of the upper sheet being substantially 10.5 cm.

Close to the outer periphery of the upper sheet 14 are printed a series of markings 16 totalling 42 markings altogether uniformly spaced apart around the periphery of the upper disc 14. The markings consist of the first letter of successive days in the week in the same order as that in which the days occur during the week, repeated cyclically, so that as one progresses around the periphery of the upper disc 14, the letters appear in the following order " . . . mtwtfssmtwtfssmtw . . . " without beginning or end, each letter being upright when viewed with that portion of the upper disc 14 which is immediately adjacent to that letter held uppermost and generally horizontal. Around the periphery of the upper face of the lower disc 12 are printed the numbers "1" to "31" 18 in succession with the same angular spacing between two immediately adjacent numbers as the angular spacing between two immediately adjacent letter markings on the upper disc 14.

With this construction, the two discs can be rotated relative to one another until the number "1" is positioned in registration with a letter marking on the upper sheet 14 corresponding to the day in the week which is the first day of a given month. It then follows that all the numbers which correspond to a day of that month will be opposite the letter which will indicate the day of the week on which that day of the month falls.

The months of the year are indicated by marks 20 on the upper sheet 14, each month being represented by a print of the first three letters of the month printed in a radially outward direction. This particular calendar is for the year 2005 so that the letters "jan" are printed immediately inwardly of a position corresponding to an "s" for Saturday, this being the day of the week on which falls 1st January 2005. Proceeding in a clockwise direction from the letters "jan" the letters "feb" are printed in a corresponding fashion against the position corresponding to the very next occurrence of the letter "t" for Tuesday, this being the day of the week on which falls 1st February 2005. The letters "mar" are printed in a corresponding fashion against the position corresponding to the next occurring Tuesday, "apr" against the next occurring Friday, "may" against the next occurring Sunday, "jun" against the next occurring Wednesday, "jul" against the next occurring Friday, "aug" against the next occurring Monday, "sep" against the next occurring Thursday, "oct" against the next occurring Saturday, "nov" against the next occurring Tuesday, and finally "dec" against the next occurring Thursday, all the while progressing in a clockwise direction around the periphery of the upper sheet 14 so that a gap corresponding to nine days is present between "dec" and "jan".

The upper sheet 14 is provided with a number of circular holes 22 punched through the card, all of which lie on one of three concentric circles 24 which are drawn in FIG. 1 for explanatory purposes only but which are only imaginary in the physical construction. Three round marks 26 are printed on the upper side of the lower sheet 12 one on each of the circles 24 at angular positions corresponding to the numbers "28", "30" and "31" respectively on the lower sheet 12. In this instance, only the mark 26 on the outer most of the circles 24 is revealed by one of the holes 22 which is a hole provided for the month of January. With the setting of the discs shown in FIG. 1, with the letters "jan" printed on the upper sheet 14 positioned in registration with the number "1" on the lower sheet 12, only the outermost of the marks 26 is visible indicating that the last day of January is the 31st of January.

Keeping with the relative positions of the sheets 12 and 14 shown in FIG. 1, the positions of the other holes 22 in the upper sheet 14 will now be described. Thus the position for the hole 22 which is used for the month of February is on the innermost circle 24 with the same angular position as that for January. The position for the hole 22 corresponding for the month of March is located on the outermost circle 24 in registration with the position corresponding to two days before the number "1" (always bearing in mind that this position may shift when the sheets are rotated relative to one another and that the positions of the holes 22 for the present are being defined in terms of the relative positioning between the sheets 12 and 14 as shown in FIG. 1). The position for the hole for the month of April is on the middle circle 24 with angular position corresponding to the printed "1". The hole 22 for May is on the outer circle 24 at the angular position of "4", June on the middle circle at "6", July on the outer circle at "9", August on the outer circle at "12", September on the middle circle at "14", October on the outer circle at "17", November on the middle circle at "19" and finally December on the outer circle at "22".

Each letter marking 16 which is immediately adjacent to one of the month markings 20 has been punched out so that there is a circular hole where that letter marking would have been, the hole itself becoming the marking, and a round hole of the same size at the same radial distance from the brass fastener 16 may be punched through the lower sheet 12 in registration with the number "1" to facilitate bringing any selected month indicator into line with the printed number "1".

Thus with the relative positioning of the two sheets 12 and 14 as shown in FIG. 1, the actual appearance of the calendar would be as shown in FIG. 2, with "jan" in registration with "1", all the printed numbers "1" to "31" in registration with letters 16 (or holes where the relevant letter has been punched out) corresponding to the days of the week on which those days of January fall, and with only that one of the round marks 26 which is in line with the day "31" appearing through the hole 22 for January, to indicate to the user that the last day of January is indeed 31st January.

It will be seen more readily from FIG. 1 that if the upper sheet 14 is rotated relative to the lower sheet 12 in an anticlockwise sense by an angle corresponding to three days ((3×360/42) degrees, that is to say 25.71 degrees bearing in mind the angular spacing between successive days is 360/42 degrees, or 8.57 degrees), "feb" aligns with "1", and only that round mark 26 which is in registration with "28" can be seen through that hole "22" on the innermost circle 24 associated with the month of February. The calendar then appears as shown in FIG. 3, with the visible mark 26 in registration with "28", being the last day of February in the year 2005. Corresponding relative positions of the sheets 12 and 14, with corresponding appearances of the calendar, may be selected for every month of the year.

Different relative positions of the markings would be used for different years.

Figure 4:
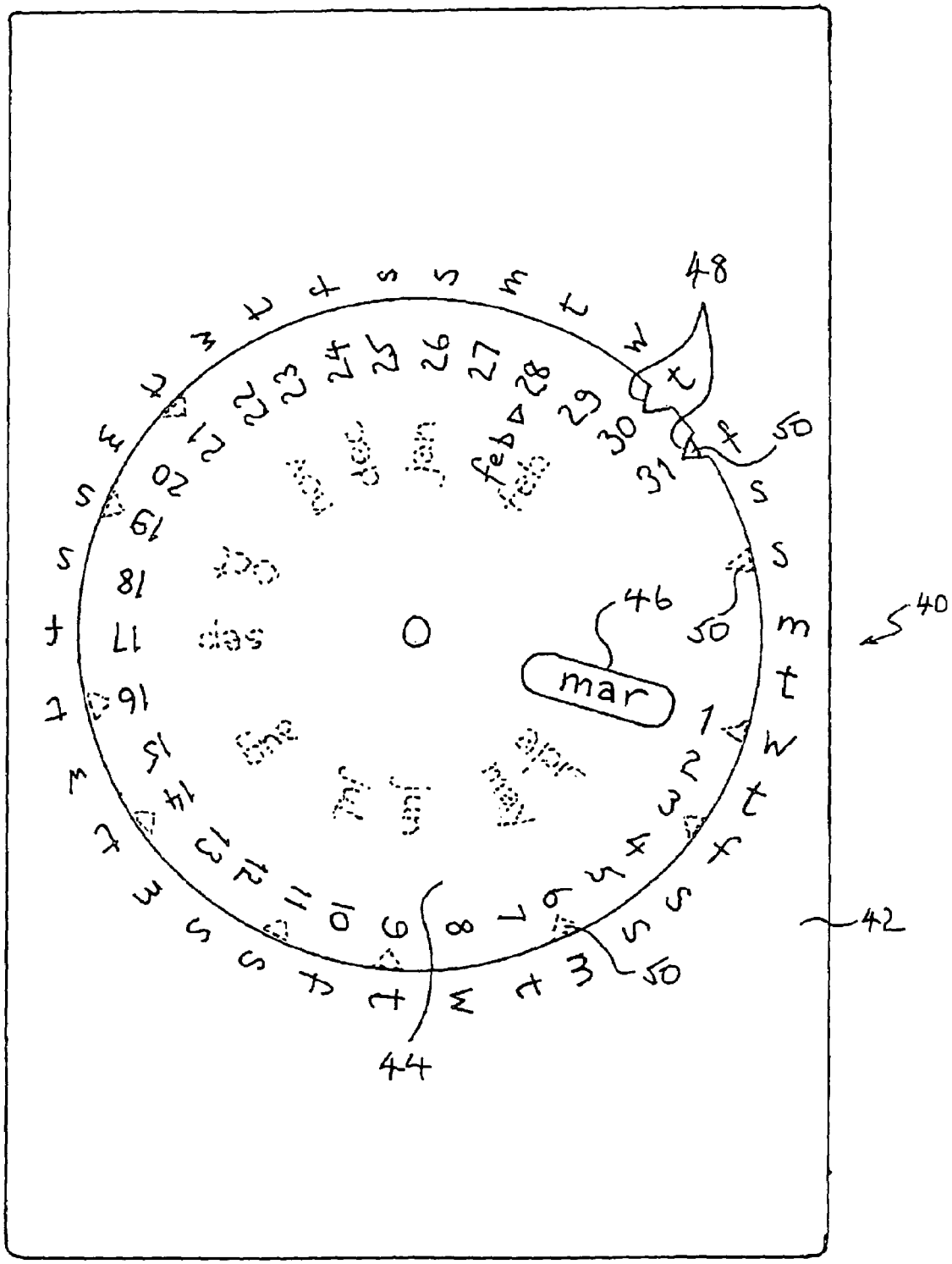
FIG. 4 shows a view of a second example of a calendar embodying the present invention from above.

In the embodiment shown in FIG. 4, the intended lower sheet is a generally rectangular plastics sheet 42, and the intended upper sheet 44 is circular, concentric with the lower sheet 42, and of a diameter which is a little less than the width of the lower sheet 42. The upper sheet 44 is made of a plastics translucent material. The markings for successive days of the week are printed on the lower sheet 42 immediately beyond the periphery of the upper sheet 44, at successive respective angular portions having equiangular spacing, for a period of five weeks, so that the first letter of each of thirty-five successive days is printed in a circle with equiangular spacing between the letters. The numbers 1 to 31 are printed on the upper sheet 42 immediately inwardly of the periphery of that sheet, with the same angular spacing between successive printed numbers as between successive printed letters on the lower sheet 42. Both the numbers and the letters progress in a clockwise direction. An aperture 46 is formed in the upper sheet 44, the aperture 46 being an elongate hole extending in a radial direction from the centre of the upper sheet 44 in alignment with the printed number 1. The first three letters of each month are printed on the lower sheet 42, with those representations of successive months being located at successive positions around the centre of the lower sheet 42 so that the first three letters of any selected month can be made to appear through the aperture 46 by appropriate relative rotation between the sheets about their common centre. The other representations (shown in broken lines in FIG. 4) of the months can be seen less clearly through the translucent material of the upper disc 44. In this way, the letters "jan" are in alignment radially with the uppermost letter "s" for "Sunday", "feb" with the first "w" for Wednesday that occurs progressing clockwise from the aforementioned "s", "mar" with the immediately following "w", "apr" with the immediately following "s" for Saturday, "may" with the immediately following "m" for Monday, "jun" with the immediately following "t" for Thursday, "jul" with the immediately following "s" for Saturday, "aug" with the immediately following "t" for Tuesday, "sep" with the immediately following "f" for Friday, "oct" with the immediately following "s" for Sunday, "nov" with the immediately following "w" for Wednesday, and "dec" with the immediately following "f" for Friday.

Two apertures in the form of triangular notches 48 are cut into the periphery of the upper sheet 44 in registration with the numbers 30 and 31 respectively.

The number "28" printed on the upper sheet 44 has the letters "feb" printed alongside it to show that 28 is the last day of the month for February. Triangular markings 50 are printed on the lower sheet 42, immediately inwardly of some of the letters representing days of the week respectively, so that one of those markings may appear through one of the notches 48 according to the relative angular positions of the two sheets 42 and 44. One of the triangular markings 50 is located adjacent to the "w" which is in registration with the marking "mar" on the lower sheet 42. Ten more triangular markings 50 are printed on the lower sheet 42, each at the same distance from the centre of the rectangular sheet 42 as the first, and spaced apart around that centre at the third, fifth, eighth, tenth, thirteenth, fifteenth, eighteenth, twentieth, thirtieth and thirty-second angular positions clockwise from the first.

As a result, if the upper sheet 44 is rotated relative to the lower sheet 42 until the letters "jan" appear through the aperture 46, a triangular marking 50 appears through the notch 48 which is adjacent to the number "31" printed on the upper sheet 44, showing that the 31st of January is the last day of January. Likewise for all the other months except only February, for which "feb" also appears opposite the number 28 to show that February has 28 days.

These markings on the lower and upper sheets of this embodiment are for the year 2006. Different positions for the markings would be required for subsequent years, and for a leap year, the "feb" last day number would be adjacent the number "29".

It will be appreciated that many variations and alterations could be made to either one of the illustrated calendars without taking it outside the scope of the present invention. To give one example only, the number of weeks represented on the upper sheet 14 of the embodiment shown in FIGS. 1 to 3 could be reduced from six to five, that is to say to thirty five days, with the angular spacing between successive days becoming 360/35 degrees, that is to say 10.28 degrees. A further disc could be used to enable the month marks 20 to be shifted in relation to the day markings 16, to provide a perpetual calendar. More than six weeks could be represented on one of the sheets, and a linear arrangement with longitudinal relative movement between the sheets would be possible. Alternatively, either or both illustrated embodiments could be adapted such that both sheets are generally cylindrical, with their outer cylindrical surfaces being used to bear markings. The calendar may be customised to highlight a particular date, event or period.

We claim:

1. A calendar comprising two sheets with one laid flat against the other and the sheets being moveable one over the other, one of the sheets being an intended lower sheet and the other sheet being an intended upper sheet, one sheet bearing the numbers "1" to "31" marked on it in order with uniform spacing between successive numbers and the other sheet bearing markings with uniform spacing between them such that the numbers can be brought into registration with respective ones of the markings, successive markings being indicative of successive days of the week in cyclical fashion for at least a full five weeks, so that the number 1 on the sheet bearing the numbers can be brought into registration with any selected one of the markings representing any day of the week, each month being represented by an indication on the sheet bearing the said markings adjacent to a marking indicative of that day of the week on which the first day of that month falls, there being apertures formed in the intended upper one of the sheets and further marks on the intended underneath sheet such that when the indication of a given month on one of the sheets is brought adjacent to the number one on the other sheet, a mark appears through one of the apertures which is in registration with that number on the said one of the sheets which corresponds with the last day of the given month.

2. A calendar according to claim 1, in which the intended lower sheet is larger than the intended upper sheet so that there is useful exposed upper surface of the lower sheet which is not covered by the upper sheet.

3. A calendar according to claim 1, in which at least one of the sheets is in the form of a disc.

4. A calendar according to claim 3, in which it is the intended upper one of the sheets which is in the form of a disc.

5. A calendar according to claim 4, in which the intended lower sheet is also circular, concentric with the upper sheet.

6. A calendar according to claim 4, in which the lower sheet is in the form of a rectangle to provide ends which can be grasped more easily.

7. A calendar according to claim 4, in which the sheets are concentric and can be rotated relative to one another about their common centre.

8. A calendar according to claim 1, in which the sheets comprise card.

9. A calendar according to claim 1, in which the sheets comprise synthetic plastics material.

10. A calendar according to claim 1, in which the apertures in the intended upper one of the discs are circular holes.

11. A calendar according to claim 1, in which the apertures are notches cut into the periphery of the intended upper sheet.

12. A calendar according to claim 1, in which the intended upper sheet is translucent so that markings in the intended lower sheet can be seen through the intended upper sheet.

13. A calendar according to claim 1, in which the intended lower sheet is the one that bears markings corresponding to the days of the week.

14. A calendar according to claim 1, in which successive month markers are spaced apart around the sheet which bears the markings indicative of the days of the week, in the same order as that in which they occur during the year.

* * * * *